United States Patent [19]

Carpenter

[11] 3,960,284

[45] June 1, 1976

[54] HYDRAULIC BACKHOE CIRCUITRY

[75] Inventor: Emerl R. Carpenter, Edina, Minn.

[73] Assignee: American Hoist & Derrick Company, St. Paul, Minn.

[22] Filed: Apr. 7, 1975

[21] Appl. No.: 565,381

Related U.S. Application Data

[63] Continuation-in-part of Ser. No. 293,819, Oct. 2, 1972, abandoned.

[52] U.S. Cl. ..... 214/138 R; 60/421; 60/428; 60/484; 60/486; 91/412

[51] Int. Cl.[2] ..... E02F 3/32

[58] Field of Search..... 214/138 R; 60/421, 428, 60/484, 486; 91/412, 414

[56] References Cited

UNITED STATES PATENTS

| | | | |
|---|---|---|---|
| 2,103,530 | 12/1937 | Henry | 60/421 |
| 3,146,593 | 9/1964 | Stacey | 60/421 |
| 3,360,925 | 1/1968 | Zimmerman | 60/421 |
| 3,583,585 | 6/1971 | Joyce | 214/138 R |
| 3,717,269 | 2/1973 | Schaeff | 214/138 R |

*Primary Examiner*—Albert J. Makay
*Assistant Examiner*—Ross Weaver
*Attorney, Agent, or Firm*—Burd, Braddock & Bartz

[57] ABSTRACT

A hydraulic backhoe utilizes two pairs of hydraulic pumps to power independent crawler track drives in any forward or reverse direction, and high or low speed ranges; allowing, for example, a wide arc turn either left or right, forward or backward. Through a novel hydraulic circuit, these pumps also power other functions such as boom, bucket and stick drives in high speed or low speed modes. This flexibility is accomplished by the use of a manually controlled track speed selector valve, an unloading valve and check valve between a track function valve and another function valve in each of the two hydraulic circuits. Full hydraulic pressure is available to all functions at all times except when a track drive is in high speed range. Conventional high-low or unloading operation of the other functions is had when the related track drive is not operating.

16 Claims, 8 Drawing Figures

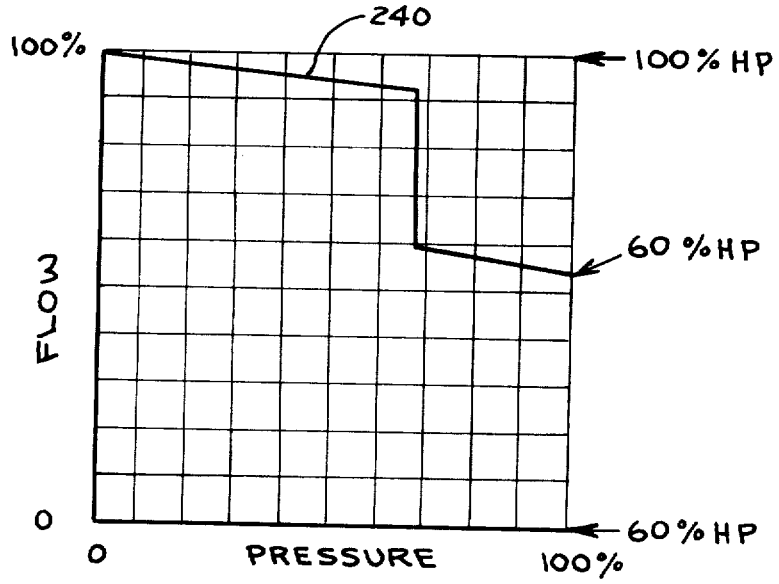
FIG. 6
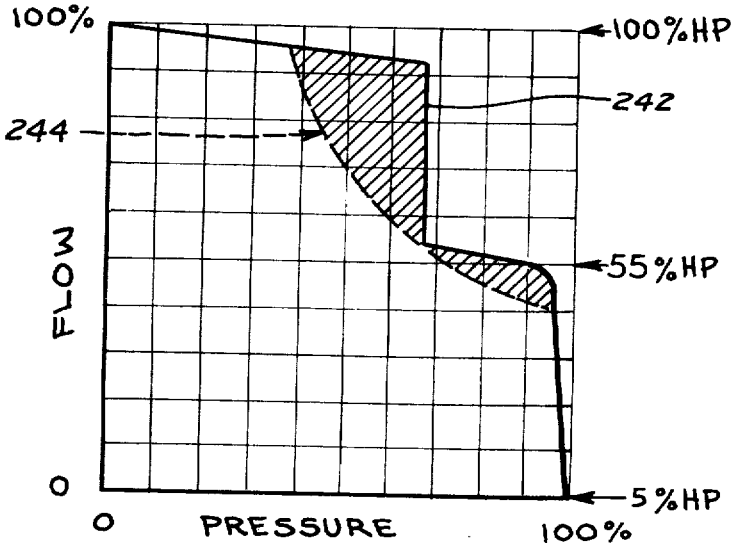
FIG. 7
FIG. 8
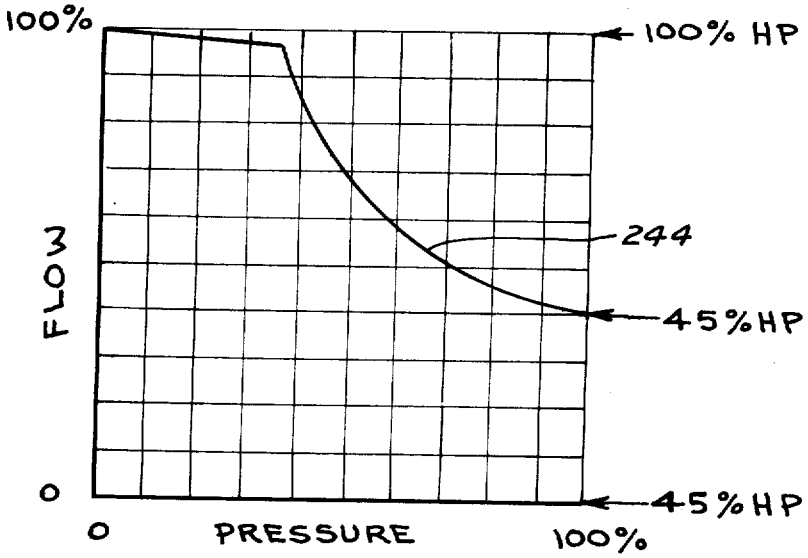

HYDRAULIC BACKHOE CIRCUITRY

CROSS-REFERENCE TO RELATED APPLICATION:

This application is a continuation-in-part of my application Ser. No. 293,819, filed Oct. 2, 1972, now abandoned.

BACKGROUND OF THE INVENTION

This invention has relation to hydraulic circuitry for a backhoe excavator. The same pair of hydraulic pumps is used to power a first set of functions such as one side of a crawler track drive, and also a second or other set of functions such as boom, bucket, stick or auxiliary drum drives.

It is desirable to perform the no-load movement of hydraulic piston-cylinder motors at relatively high speed to achieve minimum operating times for movement of boom, bucket and stick, for example. If this is achieved by use of a constant volume source of hydraulic fluid, when resistance to movement is encountered in a particular motor, as when coming under load, the pressure inside the motor will rapidly exceed the safe overload pressure and a large volume of fluid will pass out of the overload relief valve back to the fluid tank or reservoir. This is a waste of power, and occasions excessive heating of the fluid which must be compensated for by incorporation of an overly large hydraulic fluid cooling system.

If no-load movement of the hydraulic piston-cylinder motors is achieved at relatively high speed by use of large, constant horsepower control, pressure compensated variable displacement pumps as sometimes employed in prior art structures common in Europe, the flow volume will begin decreasing when something like one-half of the maximum pressure develops in the system under load, and this slow down of movement of the piston-cylinder motors will continue until the saft overload pressure is exceeded, at which point about 40% of the pumps maximum volume will pass over the relief valve and back to the fluid tank or reservoir, thus constituting a waste of power and excessive heating of the fluid.

One way to overcome these problems is by the use of two sources of fluid and an unloading valve which disconnects one of the sources from the motor and bypasses it to the return line under low pressure when the pressure in the motor lines exceeds a predetermined pressure less than the relief valve pressure.

Such high speed to low speed hydraulic systems are well known. See the patent to Vickers, U.S. Pat. No. 1,982,711, issued Dec. 4, 1934, in which pumps 1 and 2 furnish hydraulic fluid to move a power cylinder 22 until such time as a predetermined high pressure is built up in cylinder 22. At that time, an unloading valve unloads pump 2 so that Pump 1 can continue to activate the power cylinder, but at slow speed. When the pressure in cylinder 22 is reduced, as when the direction of hydraulic fluid flow into the cylinder is reversed, the unloading valve allows the hydraulic fluid from pump 2 to once again be introduced into the system for high speed operation.

The use of an unloading valve in a hydraulic circuit incorporating two hydraulic pumps to unload one of the pumps when a considerable resistance is encountered is also shown in the patent to LaRou, U.S. Pat. No. 3,156,098, issued Nov. 10, 1964. This patent is related to backhoes and diggers.

Use of a hydraulic circuit for an excavator with means to propel the excavator and associated means to power the implement is shown in the patent to Metailler, U.S. Pat. No. 3,172,552, issued Mar. 9, 1965. See FIG. 6.

Use of a low volume pump and a high volume pump to perform various functions in a backhoe vehicle is shown in the patent to Arnold, U.S. Pat. No. 3,257,013, issued June 21, 1966. A manually operable selector valve 86 can be activated to direct the output of one of the pumps to add to the output of the other pump when high speed operation is advantageous. The difficulty here is that when high resistance and therefore high pressure is encountered with the controls in that position, the overload valves will be activated, thus dumping the hydraulic fluid into the return tank, causing power waste and undue overheating of the hydraulic fluid. See FIG. 6 of Arnold.

Use of a plurality of fluid motors to operate backhoe functions at high speeds under light loads and at low speeds but higher fluid pressures under heavy loads is shown in the patent to Stacey, U.S. Pat. No. 3,146,593, issued Sept. 1, 1964.

A patent which shows two pumps operating independent track drives on a backhoe excavator is the patent to Morrison et al., U.S. Pat. No. 3,466,770, issued Sept. 16, 1969. The valving here is through a single manifold 196, however. See FIG. 7.

In the past, in order to prevent duplication of hydraulic pump circuits and controls, it has been customary to forego the ability to move a hydraulic backhoe on its crawler assembly while performing full force operations with the bucket, stick and boom.

BRIEF SUMMARY OF THE INVENTION

In hydraulic circuitry for independently driving left and right traction drive assemblies, and other functions such as the boom, bucket and stick cylinders of a backhoe, a first hydraulic circuit including two separate hydraulic pumps is utilized to drive a first of said traction drive assemblies and certain of the other functions such as the boom motor and the bucket motor, while a second hydraulic circuit including two other hydraulic pumps is utilized to drive the second of the traction drive assemblies and other functions such, for example, as the stick motor. Each of these circuits operates in essentially the same manner as the other, so the description can be limited to either of the circuits.

In a first form of the invention, the two separate hydraulic pumps utilized in each instance are disclosed as being fixed displacement pumps. In a modified form of the invention, one of the pumps remains a fixed displacement pump, while the other pump is disclosed as being a fully compensated variable displacement pump. Otherwise, the hydraulic circuitry remains the same.

In each of the disclosed forms of the invention, a first of the two independent circuits includes a normal path from a first of said pumps to a traction function valve capable of three modes of operation to either:

1. bypass the hydraulic fluid through the valve when the track is not to be driven,
2. direct the hydraulic fluid to drive a track drive motor in a forward direction, or
3. direct the hydraulic fluid to drive the motor in the reverse direction.

The output from the second pump passes to a traction speed selector valve which is normally positioned for low speed operation, directing the hydraulic fluid through it to an unloading valve, but which can be actuated for high speed operation, directing the hydraulic fluid into the traction function valve along with the output of the first pump.

The output of the second hydraulic pump and output of the first pump through bypass mode of the traction function valve and through the check valve, proceeds to another function control valve where the hydraulic fluid can be directed to bypass through that valve or operate the other functions in either forward or reverse direction.

A pressure control line transmits the pressure in the line between the traction function valve and the check valve to the unloading valve. Until a predetermined high value of pressure is reached in the hydraulic system operating one of the other functions, output from the second pump through the traction speed selection valve in its normal position joins with the output through the check valve to increase the volume of flow into and through the other function control valve, thus providing high speed operation of the other function. When resistance is encountered in the other function, however, the back pressure along the lines will rise until that in the pressure control line reaches the predetermined point at which time it will block further flow through the unloading valve and dump the fluid from pump 2 back to the reservoir. This will allow the output from pump 1 only to continue to rise in pressure until the relief valve setting is reached.

It is the excessive operation of this relief valve in machines not utilizing this invention which causes wasted power and undue heating in the hydraulic system, thus necessitating use of larger than economically feasible cooling systems for the hydraulic fluid.

The traction speed selector valve normally directs the output from the second pump to the other function control valve except at such time as the traction speed selector valve is activated to divert the output of the second pump into the traction drive function valve. At that time it is possible to drive the track at high speed, but, when the track is actually being driven at high speed there will be no hydraulic fluid available to perform the other functions. At all other times, all of the other functions and the drive of the track can be accomplished simultaneously. When the track is not being driven at any speed, the conventional high-low or unloading circuit operation of the other functions is in full effect.

When a traction drive motor is in slow speed operation, there is no flow of fluid from the traction drive function valve to the check valve. The presence of the check valve prevents back pressure from building up in the pressure control line, so the fluid flow from the second pump cannot be interrupted by the unloading valve. The precise location of the unloading pilot pressure pickup between the check valve and the traction function valve allows operation of the second pump to a relief valve pressure higher than the unloading pressure while the first pump is at full relief pressure of the traction function valve.

In a modified form of the invention, the "first pump" referred to above will be a pressure compensated variable displacement pump. The circuit will unload as set out above when a predetermined pressure exists within the system due to resistance encountered by the hydraulic piston-cylinder motor. The second pump can be a large fixed displacement pump, and after it is unloaded to deliver its hydraulic fluid to the reservoir under low pressure, the first pump will continue to deliver at substantially constant volume at higher pressures. When the pressure approaches the established maximum, the pump compensator reduces the pump displacement to its minimum, while maintaining the high pressure within the system, thus eliminating flow of high pressure fluid over a relief valve and back to the reservoir. A very small expenditure of power, say 5% of the total available horsepower in a typical case, is used to sustain the system at maximum pressure. In the drawings:

FIG. 6 is a chart of hydraulic fluid flow available to perform functions other than track drive functions plotted against pressure in the hydraulic system performing such other functions in the hydraulic circuit of the first form of the invention;

FIG. 7 is a comparable chart of flow and pressure in such other function forming part of the hydraulic circuit in the modified form of the invention; and FIG. 8 is a comparable chart of flow and pressure in a hydraulic system of the prior art employing one constant horsepower, pressure compensated variable displacement pump.

DESCRIPTION OF PREFERRED EMBODIMENTS

Figure 1:
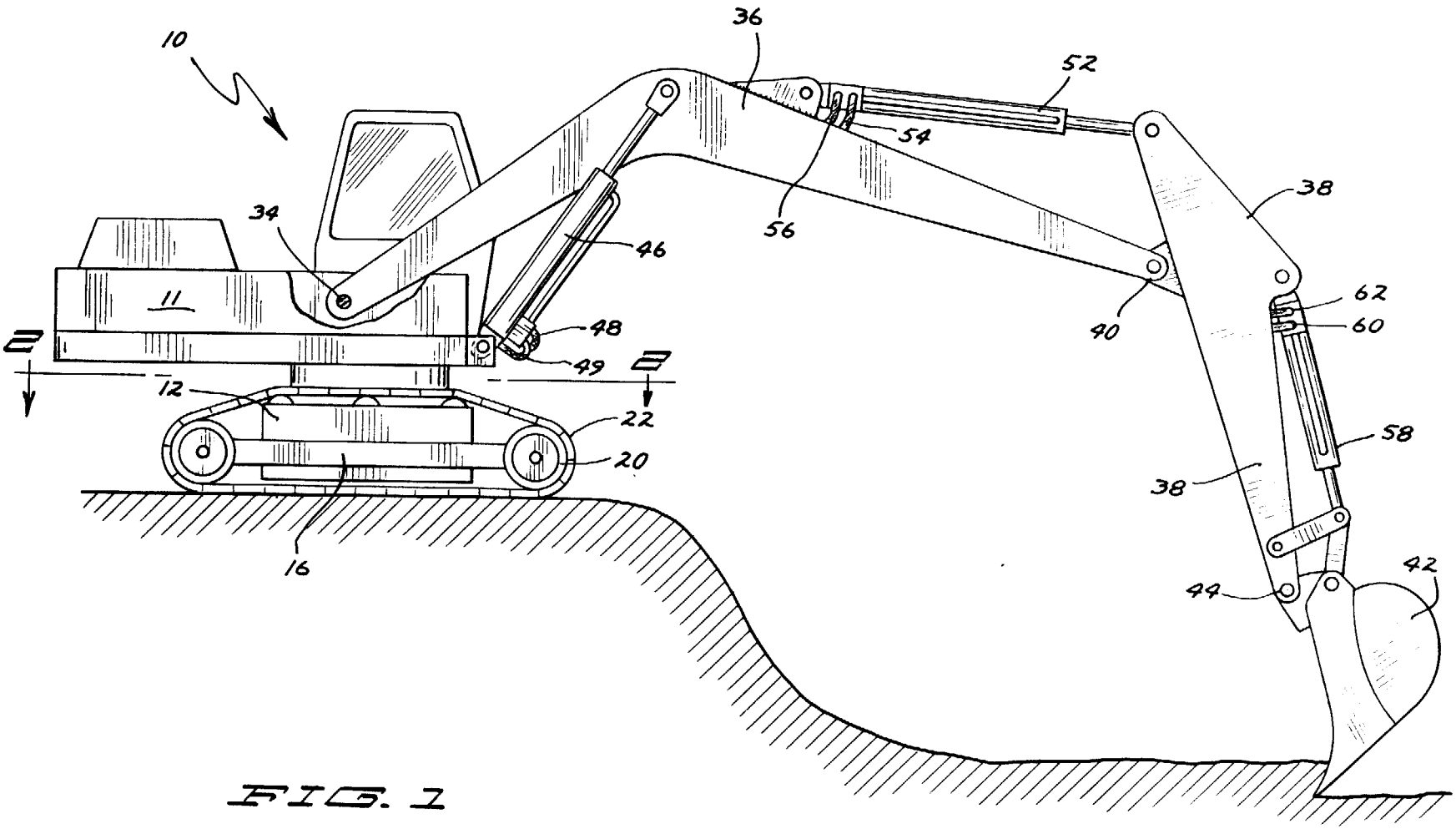
FIG. 1 is a side elevational view of a backhoe excavator showing the positioning of the boom, bucket and stick, and the boom, bucket and stick control motors.
Figure 2:
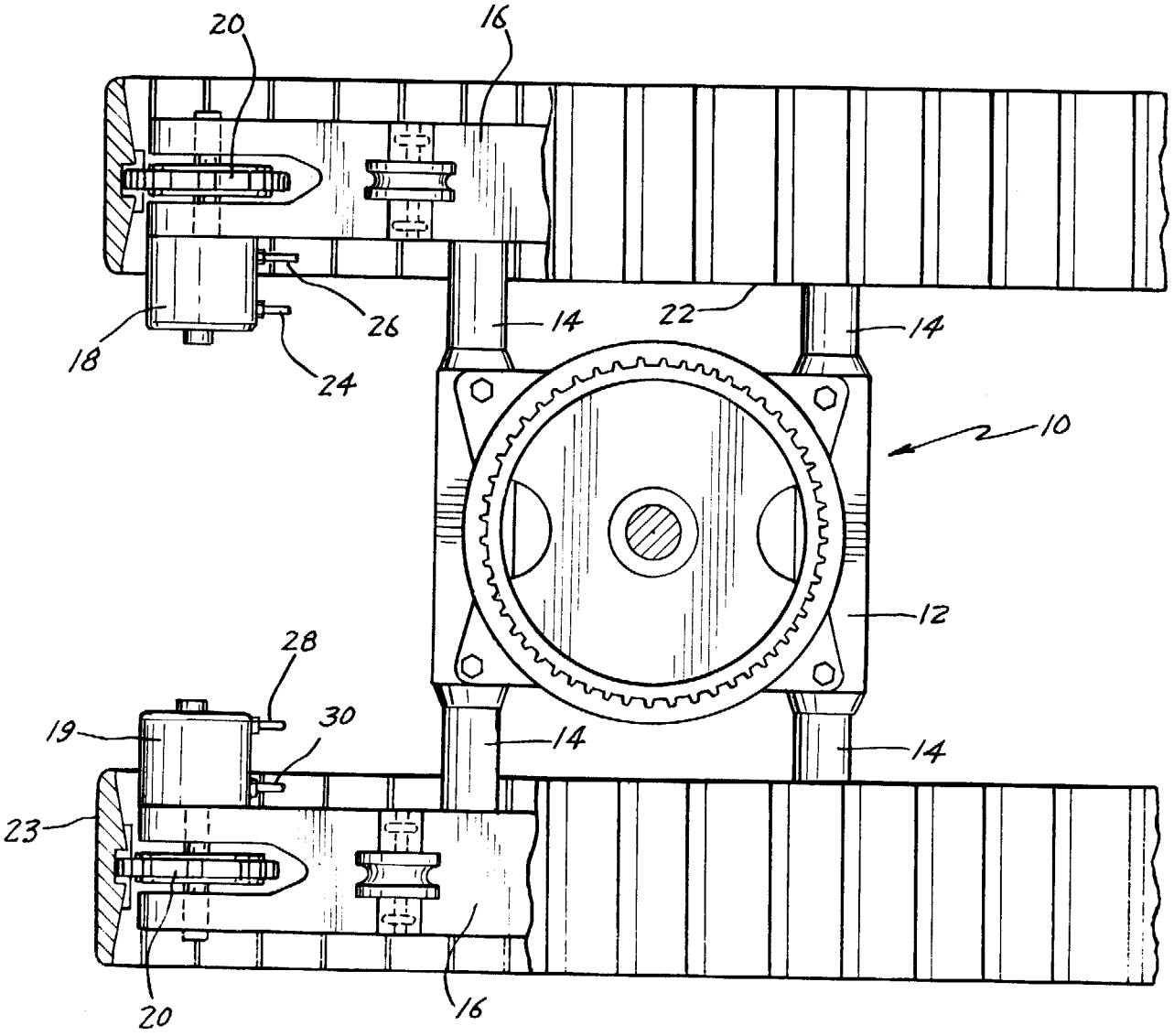
FIG. 2 is an enlarged horizontal sectional view taken on the line 2—2 in FIG. 1 showing the positioning of the track drive motors and the track drive mechanism.

In a first form of the invention as disclosed in FIGS. 1–3 and 6, a hydraulic backhoe excavator 10 includes a platform 11 rotatably mounted on a car body 12 in any usual or preferred manner. This car body is supported on axles 14 in crawler frames 16, 16. Hydraulic track drive or traction motors 18 and 19 are mounted one on each crawler frame and drive sprockets 20 and crawler tracks 22 and 23 are operably mounted on the crawler frames in any usual or preferred manner. Traction motor lines 24 and 26 extend to left traction motor 18 while traction motor lines 28 and 30 extend to the right traction motor 19. When hydraulic fluid is forced through lines 24 and 28 and into the motors 18 and 19, respectively, and consequently, out through lines 26 and 30, respectively, the motors will cause the tracks to drive the car body in forward direction. When the flow is reversed, the tracks will move the car body in reverse direction.

Pivotally mounted to the rotating platform 11 is boom 36 as at 34. A stick 38 is pivotally mounted as at 40 to the boom point; and a backhoe bucket 42 is pivotally mounted as at 44 to the outer end of the stick.

Movement of the boom 36 with respect to the rotating platform 11 is controlled by one or more boom piston-cylinder motors 46, pivotally connected between the rotating platform and the boom, as shown in FIG. 1. Boom control lines 48 and 49 extend to the boom piston-cylinder motors to selectively control extension and retraction thereof.

The relative position of the stick 38 with respect to the boom 36 is controlled by the stick piston-cylinder motor 52, to which stick control lines 54 and 56 extend.

The angular positioning of the bucket 42 with respect to the stick 38 is controlled by a bucket piston-cylinder motor 58, and bucket control lines 60 and 62 extend to this piston-cylinder motor.

Figure 3:
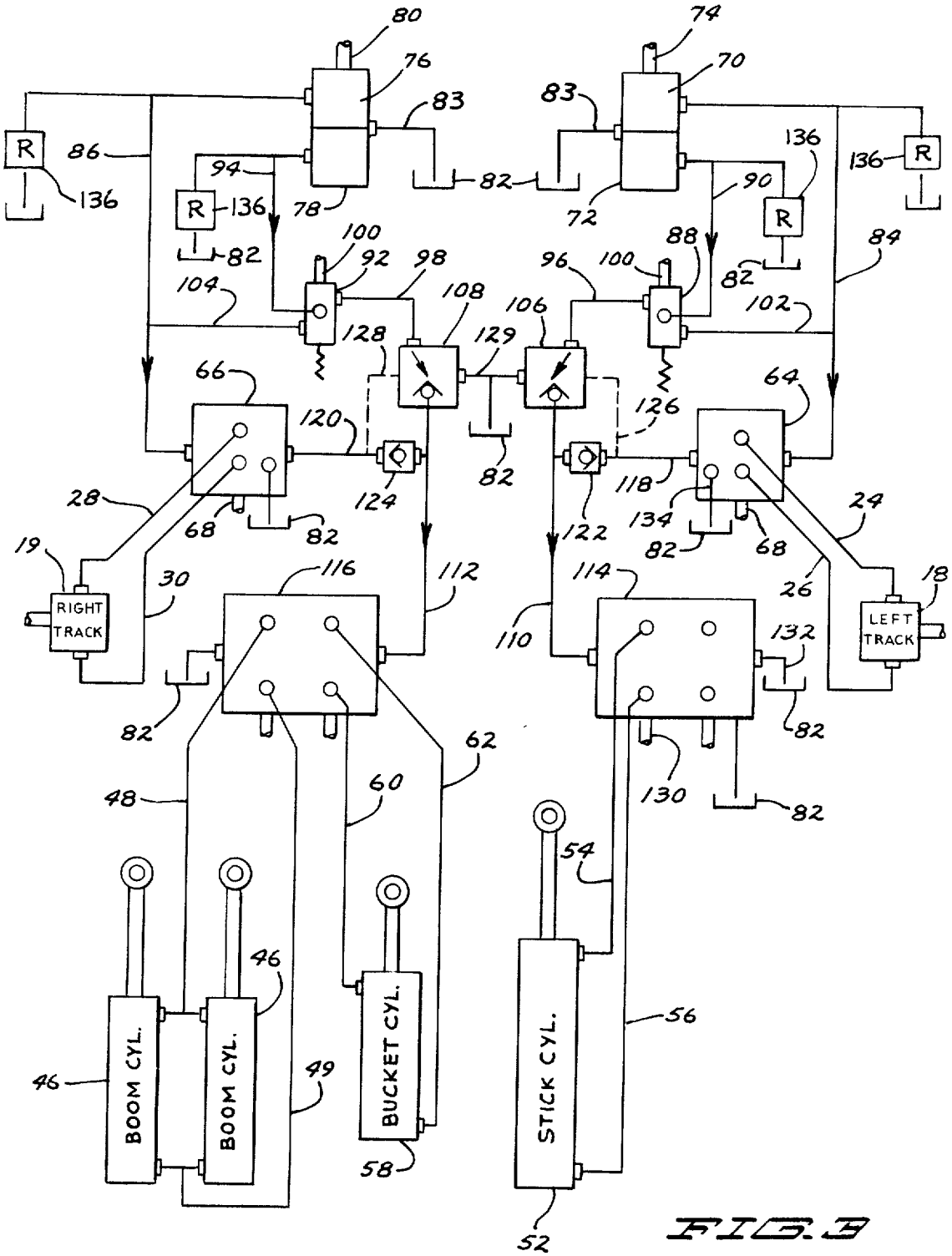
FIG. 3 is a schematic representation of the hydraulic circuitry of a first form of the invention.

As best seen from the schematic representation of the hydraulic circuits in FIG. 3, a three position crawler track or traction function valve 64 is associated with left track drive motor 18, and handles hydraulic fluid to lines 24 and 26; while a similar three position crawler track or traction function valve 66 is associated with right track drive motor 19 and handles the hydraulic fluid to lines 28 and 30. By operation of spool control 68 on each of these valves 64 and 66, hydraulic fluid supplied to the valves can be caused to flow to drive the tracks in forward direction, to drive the tracks in reverse direction, or to bypass the fluid through the valve with minimum resistance to flow.

As shown, a first hydraulic pump 70 and a second hydraulic pump 72 are both driven by a prime mover (not shown) through the instrumentality of drive shaft 74. Similarly, third hydraulic pump 76 and fourth hydraulic pump 78 are driven through the instrumentality of drive shaft 80. These become the first and second pumps of the right hydraulic system.

A reservoir for hydraulic fluid to be used by these pumps is designated conventionally by 82 as a series of open tanks wherever they appear on the hydraulic circuitry of FIG. 3.

A first hydraulic supply line 84 extends from the outlet of first pump 70 to an inlet connection of crawler track function valve 64; and a comparable hydraulic supply line 86 extends from third pump 76 to the inlet side of crawler track function valve 66. A high-low traction speed selector valve 88 is supplied by a hydraulic line 90 from the output of the second hydraulic pump 72; while a similar selector valve 92 is supplied from fourth hydraulic pump 78 through hydraulic supply line 94. These valves are normally spring biased to bypass the fluid through the valve and out through outlet lines 96 and 98, respectively; but can each be controlled, by movement of spool control 100 to divert flow to outlet lines 102 and 104, respectively. The lines 102 and 104 open into hydraulic supply lines 84 and 86, respectively, thus directing the flow from both sets of pumps into the respective crawler track function valves 64 and 66.

Normally open outlet lines 96 and 98 from the speed selector valves open to unloading valves 106 and 108, respectively. These unloading valves, when not subjected to a predetermined control pressure, permit free passage of the fluid from lines 96 and 98, through the unloading valves to lines 110 and 112, respectively, these lines forming inlet lines to function control valves 114 and 116, respectively, which control the operation of the other functions such as those of the boom, bucket and stick hydraulic-cylinder motors. To differentiate from the track function valves 64 and 66, these valves will be referred to as the other function control valves 114 and 116.

The previously mentioned flow out from the track function valves 64 and 66 is along hydraulic lines 118 and 120, respectively, and through one way check valves 122 and 124 to lines 110 and 112, thus directing hydraulic fluid from the track function valves to the other function control valves whenever the trach function valves are not being utilized to divert hydraulic fluid to power the track drive motors.

Open to each of lines 118 and 120 are hydraulic pressure control lines 126 and 128 which also open to unloading valves 106 and 108, respectively. These unloading valves can be of any usual or preferred construction, such that when the predetermined pressure builds up in line 118, for example, and consequently in pressure control line 126, unloading valve 106 will be activated to block flow to line 110 and to dump the flow at low pressure into the hydraulic reservoir 82 through return line 129. Similarly, exceeding the predetermined pressure in line 120 will result in an unloading action of valve 108 through line 129 to the reservoir.

The other function control valves 114 and 116 are of the three position type, as shown. Thus, for example, operation of the spool control 130 on other function control valve 114 can position the valve spool to either direct flow from line 110 through the valve to line 132 to the reservoir, direct flow into line 54 to cause the piston-cylinder motor 52 to retract, or can direct flow into line 56 to cause the motor to extend. Similar parts on other function control valve 116 control the functions of the boom piston-cylinder motor 46 and the bucket piston cylinder motor 58. As shown, there is one bank of function control valves not connected, but it is to be understood that this valve bank cound be connected to operate a drag line winch, for example, or to perform any other necessary or desired function. There could be any number of similar control valves banked on as a part of either of the other function control valves.

OPERATION

Since the two separate hydraulic circuits are identical in their operation, the operation of the left track and stick circuit is all that is necessary to be described.

With track function valve 64 and other function control valve 114 in neutral position and with traction speed selector valve 88 in its normal or nominal position, hydraulic fluid from reservoir 82 will flow through intake line 83 to pump 70 and out from the first pump 70, along line 84, through track function valve 64, line 118, check valve 122, line 110 and through other function control valve 114 and line 132 to the reservoir 82. At the same time, hydraulic fluid from reservoir 82 will flow through second hydraulic pump 72, line 90, traction speed selector valve 88, line 96, unloading valve 106, and into line 110 where it joins the output from the first pump in flowing through the other function control valve 114, line 132 and back to the reservoir.

When it is desired to drive the left track assembly in forward direction at normal slow speed, the spool control 68 on track function valve 64 will be activated to cause hydraulic fluid to be directed into the line 24, through right traction motor 18, and back through line 26, through the valve 64 and through outlet line 134 to reservoir 82. At that point, there will be no flow of hydraulic fluid along line 118, but the flow from second pump 72 is still present in lines 90, 96 and 110, so the stick motor 52 could be activated at low speed high pressure during the driving of the track.

Should it be desired that the track be driven in high speed, the spool control 100 will be activated to divert the flow from second pump 72 to the line 102, where the fluid from this second pump joins with the fluid from the first pump in line 84 and increases the speed of the track motor.

In this mode of operation, there is, of course, no hydraulic fluid entering the unloading valve 106, and hence no fluid flow through line 110 to power other functions controlled by valve 114.

When the track is not being driven at all, and the hydraulic fluid from pump 70 is flowing through right track function valve 64, line 118 and check valve 122 to line 110, any operation of spool control 130 to extend or contract the stick motor 52 will initially result in high speed operation of the motor 52 inasmuch as fluid from both first and second pumps 70 and 72 is being directed to the other function control valve 114 and through that valve to the stick motor 52. When the pressure in the lines builds up, as, for example, when the stick motor 52 comes under heavy load during a digging operation, the resistance to flow through line 110 will allow and cause a pressure buildup all the way back to the pumps, including in line 118. The pressure in line 118, being transmitted to the unloading valve 106 through pressure control line 126 will, when the predetermined pressure for which that valve is set is attained, cause the valve to divert flow of hydraulic fluid from line 96 to line 129, and back to the reservoir. Then only the fluid from first pump 70 will flow through line 110, and the stick motor 52 will operate in the low speed high pressure mode. This prevents excessive flow over the relief valves when the resistance to the piston-cylinder motors, motor 52, for example, becomes sufficient to stop motion thereof. Waste of energy and undue heating of the hydraulic fluid is thus substantially reduced.

While shown only in an illustrative and schematic manner, valves 64, 66, 114 and 116 contain conventional relief valves. Other relief valves are indicated at 136. The pressure at which the unloading valves 106 and 108 are triggered is below the pressure relief point of these relief valves. Thus, the relief valves never operate at the combined flow rate of both pumps during normal digging operation. When an overload causes stalling, it is only the affected first pump 70 or 76 which will be delivering full volume through the relief valves, and the energy so wasted will be only the energy lost form that pump.

While first and second pumps 70 and 72, have been shown driven by a common shaft 74 from a prime mover, this arrangement is not essential to the invention. Four individually driven pumps or any combination of multiple pumps would serve equally well.

Pumps 70 and 76 could be of either fixed or variable displacement, but the circuitry of FIG. 3 was described above as if they were fixed displacement pumps. The modified form of the invention as shown and illustrated in FIGS. 4, 5 and 7 utilizes first pumps 70 and 76 which are pressure compensated variable displacement pumps.

Figure 4:
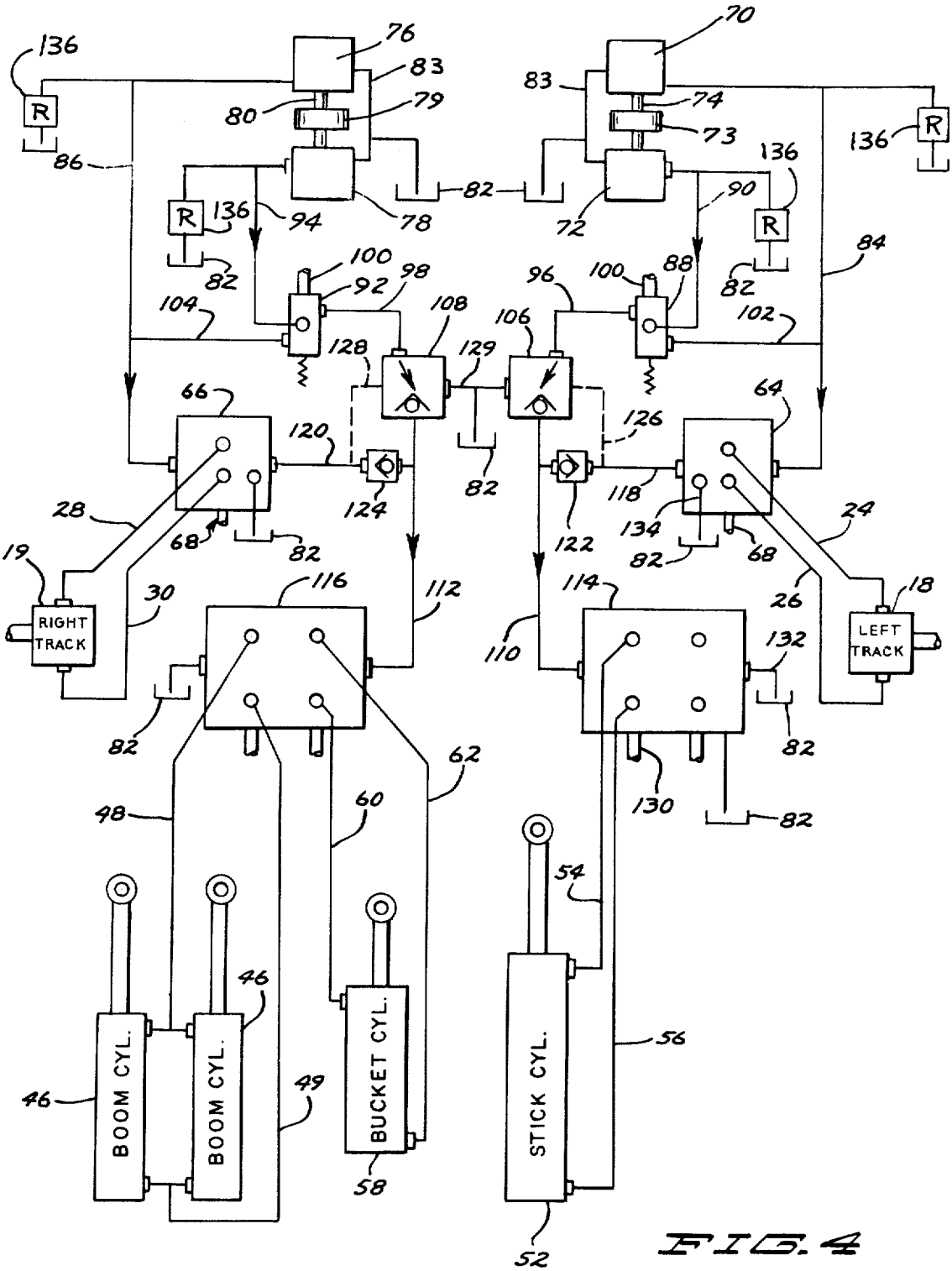
FIG. 4 is a schematic representation of hydraulic circuitry in accordance with a modified form of the invention.

The circuit of FIG. 4 is identical in all respects but one with the circuit of FIG. 3. Also, the circuit acts and reacts in the same manner as the circuit shown in FIG. 3. Therefore a detailed description of the operation of the circuit of FIG. 4 is unnecessary. Identical parts in FIGS. 3 and 4 are identically numbered.

Figure 5:
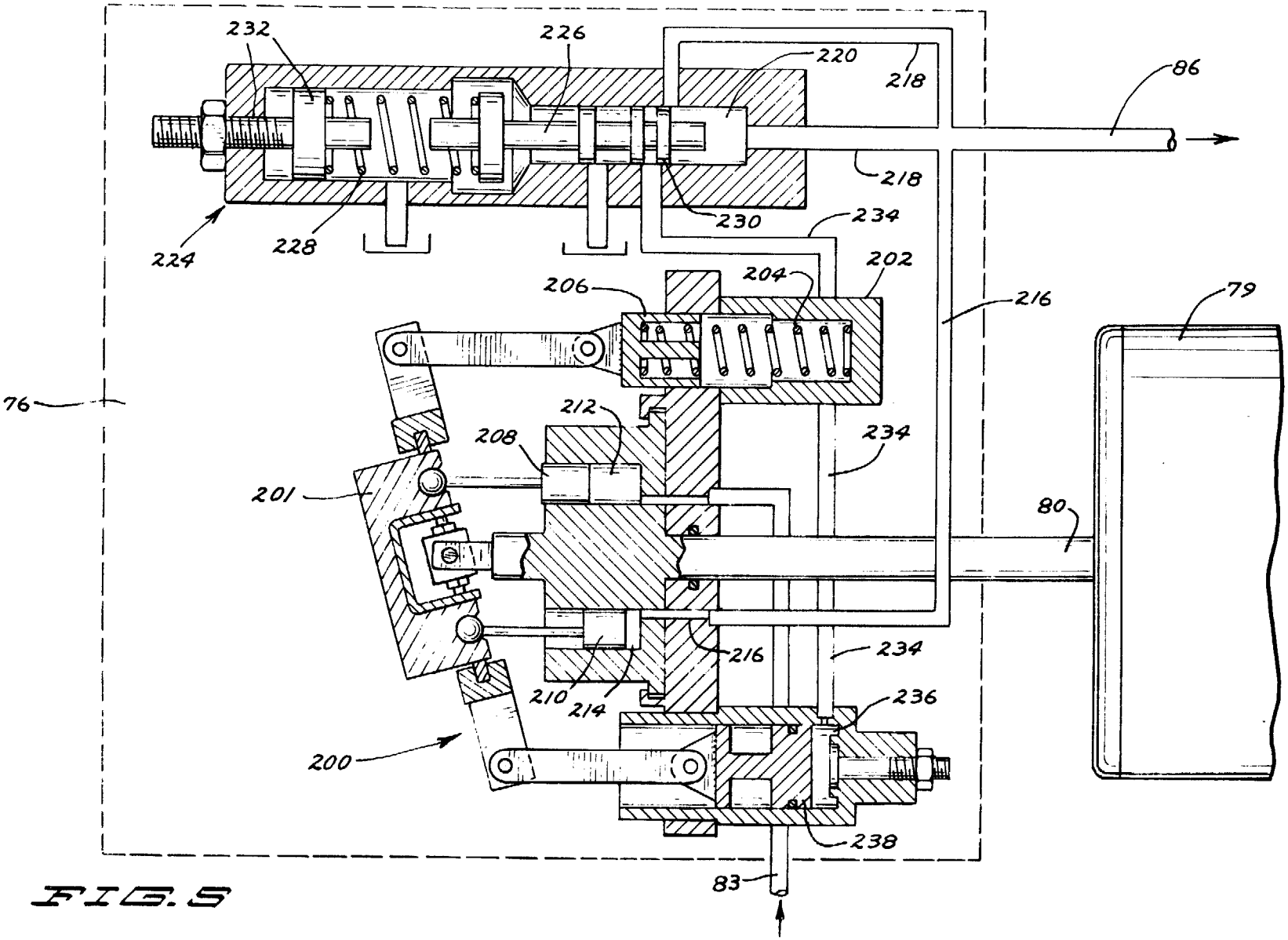
FIG. 5 is a partially schematic, elevational view of a pressure compensated variable displacement pump useful in connection with the modified form of the invention, with parts in section and parts broken away.

In the modified form of the invention, a particular adaptation using a pressure compensated variable displacement pump will be set forth. As seen in FIG. 4, a first pump 70 is driven by the shaft 74 from prime mover 73 while first pump 76 is driven by shaft 80 and powered by prime mover 79. The structure of the pressure compensated pump 70 can be the same as the pressure compensated first pump 76, which is disclosed in FIG. 5. A swash-plate pump 200 is shown, but other types of variable displacement pumps would serve equally well. First pump 76 includes swash-plate pump 200 having a swash-plate 201 and a first servo controlled cylinder 202 in which a compression coil spring 204 is situated to mechanically force first servo controlled piston 206 to the position as seen in FIG. 5, thus affording the maximum displacement of pump pistons 208 and 210 in pump cylinders 212 and 214 respectively. This causes the pump 76 to deliver its maximum volume through internal pump discharge passageway 216, and to the first hydraulic supply line 86.

Pump 76 continues to supply its full volume of hydraulic fluid to the line 86 up to and beyond the point that the pressure in line 120 and through control line 128 causes unloading valve 108 to dump the flow of hydraulic fluid from second pump 78 to the reservoir.

If the resistance to movement continues to increase, the pressure will continue to build up in first pump 76 and in pressure control line 218 in that pump which is open to a spool control valve cylinder 220 of a spool control valve 224. This pressure control line 218 is also open to the first hydraulic supply line 86. A spool 226 of the spool control valve 224 is spring forced in direction to the right as seen in FIG. 5 by a compression coil spring 228. The spool also includes a piston 230 sealingly and operatively mounted in spool control valve cylinder 220.

Adjustment structure 232 is provided to control the force exerted by spring 228 to an amount such that the spool 226 will not begin to move to the left until just before the maximum allowable pressure in the system is reached. At this point, the pressure of the system through line 86 and pressure control line 218, acting in spool control valve cylinder 220 on piston 230 does force the spool to the left until such time as a port in valve 224 open to a conduit 234 receives fluid past the piston 230 from the cylinder 220. This conduit 234 leads to a second servo control cylinder 236 having a piston 238 therein. This hydraulic fluid under pressure forces the swash-plate 201 toward a position parallel with the pump, thus reducing the output of the pump to the point where the only hydraulic fluid flowing at stalled conditions is the fluid necessary to main the pressure in control line 218 to the point where the spool 226 has sufficient movement to maintain cutoff pressure in second servo control cylinder 236 through conduit 234.

In a typical case where, in accordance with the first form of the invention, a constant displacement pump is used as the first pump, the power lost through the relief valves under stall conditions can be on the order of 60% of the horsepower available. in contrast, with a pressure compensated pump acting in the manner described, the power lost under stall conditions will be on the order of magnitude of 5% of the available horsepower.

This savings in power is illustrated graphically in FIGS. 6 and 7 in which pressure and flow is expressed as percentages.

In FIG. 6, for the form of the invention as shown in FIG. 3 and with the first pump being of the constant displacement type, the pressure developed in line 110 or line 112 is plotted at 240 against the flow in the same line. Flow rate determines the speed with which a piston is moving with respect to its cylinder in one of the other function motors. Under low pressure, maximum speed is obtained until the control pressure for operation of the unloading valves 106 or 108 is reached.

At that point, at 70% pressure as shown, the output of the second pump is switched off, and the flow or speed of the parts is reduced. At stall, when 100% of the available pressure is achieved, the relief valves will open, and all of the energy of the first pump will be lost through the relief valve in the form of heat in the hydraulic fluid.

To the right of FIG. 6, the percentage of available horsepower is indicated at the top of the chart. A typical figure for available horsepower at stall is 60%, as shown at the stall point on the chart of FIG. 6. This 60% horsepower is being wasted under stall conditions.

FIG. 7 is a plot at 242 of flow against pressure in line 112, for example, in the form of the invention as seen in FIG. 4, and in which first pump 76 is a pressure compensated variable displacement pump operating in the manner described above. Under low pressure conditions, as seen in FIG. 7, the flow rate, or speed of the parts relative to each other stays at a maximum until such time as the pressure in line 120 and control line 128 causes left unloading valve 108 to dump the fluid from second motor 78 to the reservoir 82 at low pressure. At this point, the first pump 76 continues to deliver hydraulic fluid into first hydraulic line 86 at its maximum rate until just before the stall point is reached. At this point, the spool control valve 224 introduces hydraulic fluid under the maximum pressure into the second servo control cylinder 236 in the manner described above, and the volume from the swashplate pump 200 is drastically curtailed. Then when the stall out pressure is reached and the parts no longer move with respect to each other at the hydraulic piston-cylinder other function motor, the first pump 76 is delivering only enough fluid to maintain pressure sufficient to balance spring 228.

FIG. 8 is a similar flow against pressure plot at 244 for a prior art situation in which a large single constant horsepower pressure compensated variable displacement pump is used. In order to be able to provide sufficient flow so that the no load and low load speed of the parts relative to each other in the hydraulic piston-cylinder other function motors such as 46 and 58 is comparable with the no load speeds achieved in connection with the present invention, an extremely large pump must be used. This is economically a very substantial drawback. Further, with only one pump there can be no unloading system, and the pump must be so constituted that the pressure compensation begins to take place when the pressure is somewhere in the general neighborhood of 40% of the maximum pressure allowable. At this point, the flow-pressure curve falls and, as the pressure increases, the speed of the other functions must continually decrease until the stall point is reached. At that stall, a typical value of the horsepower available would be 45% of the maximum. At this point, 45% horsepower is being delivered by the single pump through the relief valves and into the reservoir system in the form of heat in the hydraulic fluid. This is all lost energy.

Referring back to FIG. 7, the curved portion of plot 244 of FIG. 8 has been superimposed on FIG. 7, to show the difference in performance characteristics as far as speed of performing the functions is concerned. The shaded area represents the difference in effective power supplied to the functions under the two situations. The difference in the flow or speed of performing the function is readily apparent as well. In the apparatus of the invention, the speed holds up to substantially 100% until the point where the unloading valve works, and then holds up at substantially half speed until just before the first pump 76 drops the great majority of its power and cuts its volume, preparatory to reaching the stall pressure, at which only 5% horsepower goes to heat in the hydraulic fluid.

The embodiments of the invention in which an exclusive property or privilege is claimed are defined as follows:

1. A hydraulic circuit for selectively performing a first function at a first slower speed, at a second higher speed and not performing that function; and selectively for performing or not performing a second function, said circuit including:

a first hydraulic pump;
a first function motor;
a first hydraulic path from said pump to said motor to carry fluid to drive said motor;
said first path including a first function control valve;
a second hydraulic pump;
a second function motor;
a second hydraulic path from said second pump to said second function motor to carry fluid to drive said second motor;
said second path including in order from said second pump toward said second motor;
a first function speed selector valve,
an unloading valve, and
a second function control valve; said speed selector valve being selectively operable:
A. to form a part of said second path, and
B. to block flow in said second path and to divert it to said first path to augment the output from said first pump to said first function control valve;
said first function control valve being selectively operable:
A. to form a part of said first path to permit fluid therein to pass to said first function motor to perform said first function, and
B. to block flow in said first path to said first function motor and divert it to a first function control valve outlet line;
said first function control valve outlet line opening to a one way check valve;
said check valve opening to said second path between said unloading valve and said second function control valve;
there being a pressure control line open from said first function control valve outlet passageway to said unloading valve;
said unloading valve being operable responsive to the presence of a predetermined pressure in said pressure control line to divert flow of fluid from said second pump away from said second path;
said second function control valve being selectively operable;

A. to form a part of the second path to permit the passage of fluid therealong to operate said second function motor, and B. to block said second passageway to divert said hydraulic fluid from said second motor.

2. A fluid circuit including:

first and second fluid pumps;

first and second fluid motors;

a first fluid path for delivering fluid from said first pump to said first motor, said first path including a first function control valve;

a second fluid path for delivering fluid from said second pump to said second motor;

speed selector means in said second path for selectively diverting fluid from said second pump into said first path;

a third path open from said first function control valve to said second path;

said first function control valve being selectively operable:

A. to form a part of said first path to pass fluid therein to said first motor, and B. to divert fluid in said first path into said third path;

second function control valve means in said second path selectively operable:

A. to form a part of said second path to pass fluid therein to said second motor, and B. to divert fluid in said second path from said second motor.

3. The fluid circuit of claim 2 and one way valve at the junction of said third path and said second path for preventing flow of fluid from said second path along said third path when there is no flow of fluid from said first function control valve into said third path.

4. The circuit of claim 3 and unloading means in said second path for diverting the flow of fluid from said second pump away from said second motor responsive to the presence of at least a predetermined pressure in said third path.

5. The circuit of claim 4 and means for preventing reverse flow in said second path past said unloading means.

6. The circuit of claim 4 wherein said fluid is hydraulic liquid;

a reservoir for storing said liquid; and wherein said circuit is comprised of a plurality of closed loops, at least some of which include said reservoir, intake conduits from said reservoir to said pumps, and conduits from said unloading means and said first and second function valves and opening to said reservoir.

7. A backhoe excavator having right and left crawler tracks, and a driveable boom, stick and bucket, said excavator including two circuits as set out in claim 6, said first function motors each driving one of said tracks, and said second function motors each driving at least one of said boom, stick and bucket.

8. A fluid circuit for selectively performing a first function at a first slower speed, at a second higher speed and not performing that function; and selectively for performing or not performing a second function, said circuit including:

a first fluid pump;

a first function motor;

a first fluid path from said pump to said motor to carry fluid to drive said motor;

said first path including a first function control valve;

a second fluid pump;

a second function motor;

a second fluid path from said second pump to said second function motor to carry fluid to drive said second motor;

said second path including in order from said second pump toward said second motor;

a first function speed selector valve, an unloading valve, and a second function control valve;

said speed selector valve being selectively operable:

A. to form a part of said second path, and

B. to block flow in said second path and to divert it to said first path to augment the output from said first pump to said first function control valve;

said first function control valve being selectively operable:

A. to form a part of said first path to permit fluid therein to pass to said first function motor to perform said first function, and B. to block flow in said first path to said first function motor and divert it to a first function control valve outlet line;

said first function control valve outlet line opening to a one way check valve;

said check valve opening to said second path between said unloading valve and said second function control valve;

there being a pressure control line open from said first function control valve outlet passageway to said unloading valve;

said unloading valve being operable responsive to the presence of a predetermined pressure in said pressure control line to divert flow of fluid from said second pump away from said second path;

said second function control valve being selectively operable:

A. to form a part of the second path to permit the passage of fluid therealong to operate said said function motor, and B. to block said second passageway to divert said hydraulic fluid from said second motor.

9. The circuit of claim 3 and unloading means in said second path for diverting the flow of fluid from said second pump away from said second motor responsive to the presence of at least a predetermined pressure in said third path.

10. The circuit of claim 1 wherein said first and second hydraulic pumps are of a fixed displacement type.

11. The fluid circuit of claim 1 wherein said first pump is a pressure compensated, variable displacement pump.

12. The hydraulic circuit of claim 11 wherein said first pump is pressure compensated in such a manner as to drastically limit its volumetric displacement only at a point where slightly less than the maximum allowable system pressure is achieved in the output of the pump.

13. In combination with a backhoe excavator having right and left crawler tracks, a driveable boom, stick and bucket, a first function motor for driving a first of said tracks, separate function motors for driving each of said boom, stick and bucket, and means for driving a second of said tracks; a hydraulic circuit including:

a first hydraulic pump;

said first track function motor;

a first hydraulic path from said pump to said motor to carry fluid to drive said motor;

said first path including a first track function control valve;

a second hydraulic pump;

at least one second function motor for driving one of said boom, stick and bucket;

a second hydraulic path from said second pump to said second function motor to carry fluid to drive said second motor;

said second path including in order from said second pump toward said second motor:

a first function speed selector valve, an unloading valve, and a second function control valve;

said speed selector valve being selectively operable:

A. to form a part of said second path, and

B. to block flow in said second path to divert it to said first path to augment the output from said first pump to said first function traction control valve;

said first function control valve being selectively operable:

A. to form a part of said first path to permit fluid therein to pass to said first function motor to perform said first function, and B. to block flow in said first path to said first function motor and to divert it to a first function control valve outlet line;

said first function control valve outlet line opening to a one way check valve;

said check valve opening to said second path between said unloading valve and said second function control valve;

there being a pressure control line open from said first function control valve outlet passageway to said unloading valve;

said unloading valve being operable responsive to the presence of at least a predetermined pressure in said pressure control line to divert flow from said second motor away from said second path; and said second function control valve being selectively operable:

A. to form a part of the second path to permit the passage of fluid therealong to operate said second function motor, and B. to block said second passageay to divert said hydraulic fluid from said second motor.

14. The hydraulic circuit of claim 13 wherein said first and second hydraulic pumps are of a fixed displacement type.

15. The hydraulic circuit of claim 15 wherein said first pump is a pressure compensated, variable displacement pump.

16. The hydraulic circuit of claim 15 wherein said first pump is pressure compensated in such a manner as to drastically limit its volumetric displacement only at a point where slightly less than the maximum allowable system pressure is achieved in the output of the pump.

* * * * *